US009683413B1

(12) United States Patent
Smith

(10) Patent No.: US 9,683,413 B1
(45) Date of Patent: Jun. 20, 2017

(54) DRILLING RISER JOINT WITH INTEGRATED MULTIPLEXER LINE

(71) Applicant: Cameron International Corporation, Houston, TX (US)

(72) Inventor: Nate Smith, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/143,024

(22) Filed: Apr. 29, 2016

(51) Int. Cl.
*E21B 17/01* (2006.01)
*E21B 17/046* (2006.01)
*E21B 17/08* (2006.01)

(52) U.S. Cl.
CPC ..... *E21B 17/046* (2013.01); *E21B 17/01* (2013.01); *E21B 17/085* (2013.01)

(58) Field of Classification Search
CPC ..... E21B 17/01; E21B 17/046; E21B 17/085
See application file for complete search history.

(56) References Cited

U.S. PATENT DOCUMENTS 5,046,896 A * 9/1991 Cole ..... B63B 22/021 166/344
5,676,209 A * 10/1997 Reynolds ..... E21B 17/012 166/345
6,734,805 B2 * 5/2004 Johnson ..... E21B 17/00 138/123
7,216,714 B2 * 5/2007 Reynolds ..... E21B 33/035 137/557
7,988,104 B1 * 8/2011 Cook ..... H02G 3/32 248/68.1
8,272,444 B2 * 9/2012 Baugh ..... E21B 17/01 166/250.01
8,413,724 B2 * 4/2013 Carbaugh ..... E21B 17/085 166/344
8,540,029 B2 * 9/2013 McMiles ..... E21B 17/01 166/345
9,121,229 B2 * 9/2015 Gallagher ..... E21B 17/01
9,222,327 B2 * 12/2015 Humphreys ..... E21B 33/038
2012/0037377 A1 2/2012 Walker
2014/0190701 A1 * 7/2014 Humphreys ..... E21B 17/017 166/345
2015/0167398 A1 * 6/2015 Hoefler ..... E21B 17/085 166/367
2016/0032662 A1 * 2/2016 Walker ..... E21B 17/085 166/367

* cited by examiner

*Primary Examiner* — Matthew R Buck
(74) *Attorney, Agent, or Firm* — Gable Gotwals

(57) ABSTRACT

A drilling riser joint includes at least one multiplexer line arranged in a longitudinal direction along a main line of the drilling riser joint, each end of the multiplexer line extending through a respective flange of the drilling riser joint and arranged for coupling to an opposing mux line of a second drilling riser joint. When the riser joints are coupled together, a single multiplexer line is formed along the drilling riser.

8 Claims, 2 Drawing Sheets

DRILLING RISER JOINT WITH INTEGRATED MULTIPLEXER LINE

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates to systems and devices used to secure multiplexer ("mux") lines to riser systems used in oil and gas drilling applications.

Prior art systems either use the riser's auxiliary line clamps for the mux lines or place mux clamps on the auxiliary lines. In all cases, the mux line must be strung or installed along the entire riser system and, once installed, experiences buoyancy.

Installing mux lines on the riser is potentially dangerous because the installers must work from baskets or moon pools over open water. The installation is also time consuming. Because the mux the lines experience buoyancy, the lines become damaged over time and require replacement.

A need exits for a system that improves installation safety, reduces the time needed to run riser, and extends the operational life of mux lines.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments of a riser joint, the riser joint include one or more integrated multiplexer ("mux") lines that extend in a longitudinal direction of the riser joint and lie snug against the main line of the riser joint. Each end of the mux line extends through its respective riser joint flange for connection to an opposing end of a mux line of an adjacent riser joint. The ends may be arranged as box-and-pin couplers or as inductive couplers.

As the riser joints are connected one to the other, a complete mux line is formed along the entire riser system. Because each mux line segment lies snug against the main line of the riser joint, the buoyancy is fitted around the line rather than the line experiencing buoyancy.

Objectives of embodiments of the riser joint are to increase the operational lifespan of mux line by increase safety and reduce time and costs when running riser.

Figure 1:
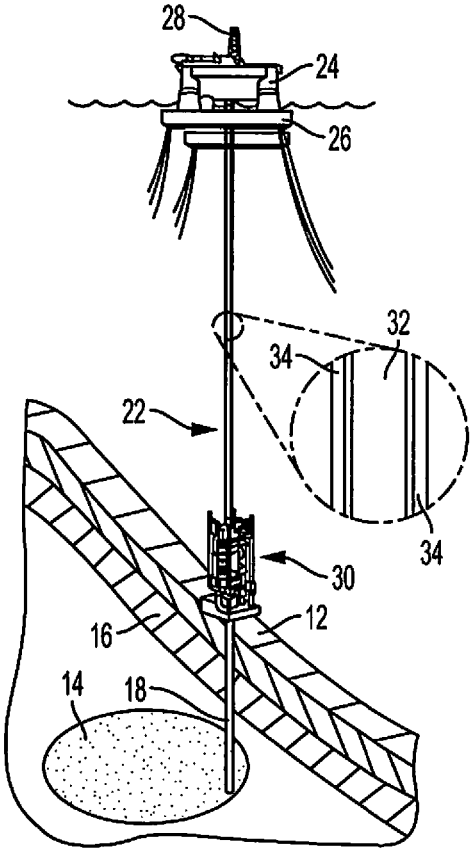
FIG. 1 is a diagram that illustrates a typical subsea mineral extraction system. A drilling riser extends from the blowout preventer to the drilling rig
Figure 2:
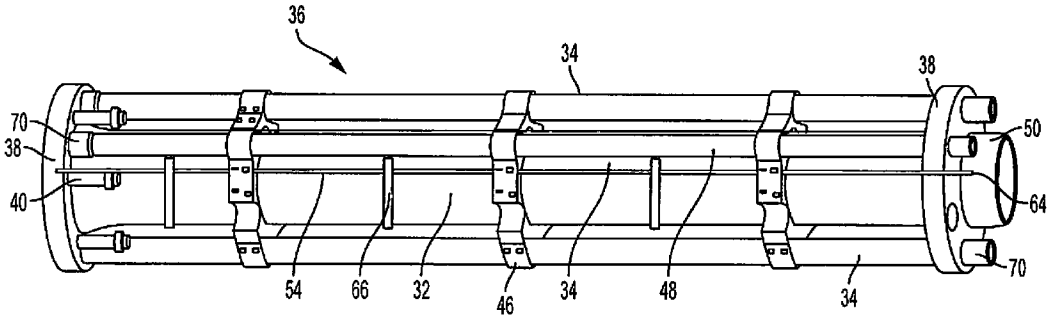
FIG. 2 is an isometric view of an embodiment of a drilling riser joint. The riser joint includes a multiplexer ("mux") line lying snug against the main line of the riser joint and having a coupler at each end for connection to an adjacent riser joint.
Figure 3:
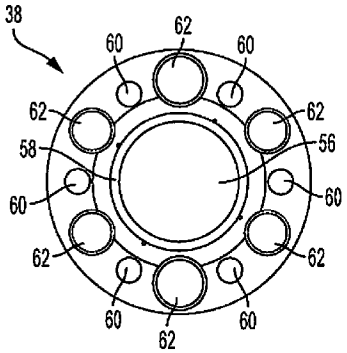
FIG. 3 is an end view of an embodiment of the drilling riser joint.

The subject disclosure is further described in the following detail description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

ELEMENT NUMBERING AND ELEMENTS USED IN THE DRAWINGS AND DETAILED DESCRIPTION

12 Wellhead
14 Mineral deposit
16 Well
18 Well bore
22 Drilling riser
24 Rig
26 Vessel
28 Derrick
30 Blowout preventer ("BOP)" stack
32 Main line
34 Auxiliary line
36 Riser joint
38 Flange
40 Bolt
46 Auxiliary line clamp
48 Aluminum (or steel) tube
50 Steel portion
54 Mux line segment
56 Central bore
58 Annular seal
60 Bolt holes
62 Line holes for 34, 54
64 Coupling end of 54
66 Mux line clamp or band
70 Coupling end of 48

DETAILED DESCRIPTION

One or more specific embodiments of the present disclosure will be described below. These described embodiments are only exemplary of the present disclosure. Additionally, in an effort to provide a concise description of these exemplary of embodiments, all features of an actual implementation may not be described in the specification. It should be appreciated that in the development of any such actual implementation, as in any engineering or design project, numerous implementation-specific decisions must be made to achieve the developers'specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of a riser joint include one or more integrated multiplexer ("mux") lines that extend in a longitudinal direction of the riser joint and lie snug against the main line of the riser joint. Each end of the mux line extends through its respective riser joint flange for connection to an opposing end of a mux line of an adjacent riser joint. The ends may be arranged as box-and-pin couplers or as inductive couplers.

As the riser joints are connected one to the other, a complete mux line is formed along the entire riser system. Because each mux line segment lies snug against the main line of the riser joint, the buoyancy is fitted around the line rather than the line experiencing buoyancy.

Referring to FIG. 1, a typical subsea mineral extraction system includes a drilling rig 24, a wellhead 12 situated above a well 16, a blowout preventer ("BOP") stack 30 coupled to the wellhead 12, and a drilling riser 22 running between the BOP stack 30 and drilling rig 20. A derrick 28 can be used to support the drilling riser 22 during its running and retrieval.

The drilling riser 22 is formed from numerous riser joints 36 coupled together via flanges 38 and bolts 40 (see e.g. US 2012/0037377 A1 to Cameron International Corporation, hereby incorporated by reference herein). The flange 38 includes a central bore 56 similar in inside diameter to the main line 32 and an annular seal 58 to seal the flange 38 against the flange of an adjacent riser joint. Additionally, the flange 38 includes a holes 60 configured to receive the bolts 40. To provide for assembly of the auxiliary lines 34 and mux line segments 54, the flange 38 includes one or more holes 62 to allow for passage of the lines 34, 54 through the flange 38.

Once assembled, the drilling riser 22 carries drilling fluid or mud from the rig 24 to the well 16 and returns drilling fluid along with cuttings or other substances from the well 16 to the rig 24. The riser 22 includes a main line 32 having a large diameter and one or more smaller diameter auxiliary lines 34. The auxiliary lines 34 include choke lines, kill lines, hydraulic lines, glycol injection, mud return, or mud boost lines. Auxiliary line clamps 46 spaced along the riser 22 typically secure the lines 34 to the main line 32.

The auxiliary lines 34 may include an aluminum tube 48 with steel portion 50 that is coupled—using, for example, box-and-pin fittings 70—to that of an adjacent riser joint 36 (see e.g. US 2012/0037377 A1 for various coupling arrangements). Once all of the riser joints 36 are joined together, each auxiliary line 34 forms a continuous line along the length of the riser 22.

Similarly, the one or more integrated mux line segments 54 that lie snug against the main line 32 of the riser joint 36 can be connected to opposing mux line segment of an adjacent riser joint. Each end 64 of the mux line 54 extends through its respective riser joint flange 38 for connection to an opposing end 64 of a mux line 54 of an adjacent riser joint 36. The ends 64 may be arranged as box-and-pin couplers or inductive couplers. Once all of the riser joints 36 are connected in this way, each mux line 54 forms a continuous line along the length of the riser 22. Each mux line 54 can be secured against the main line by a band or clamp 66.

Embodiments of a method of running a multiplexer line along a drilling riser 22 includes the step of coupling a first multiplexer line segment 54 extending between flanges 38 of a first drilling riser joint 36 to a second multiplexer line segment 54 extending between flanges 38 of a second drilling riser joint 36. Each multiplexer line segment 54 includes an end 64 that extends through a respective flange 38 of the drilling riser joint 36. When coupled together, either by box-and-pin fittings or by inductive coupling, the first and second multiplexer line segments 54 form a portion of the multiplexer line along the drilling riser 22.

The embodiments described above and illustrated in the drawing figures provide examples of the drilling riser joint. The disclosure may be susceptible to various modifications and alternative forms, embodiments have been shown by way of example in the drawing and have been described in detail herein. However, it should be understood that the disclosure is not intended to be limited to the particular forms disclosed. Rather, the disclosure is to cover all modifications, equivalents, and alternatives falling within the spirit and scope of the disclosure as defined the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any manner, it is intended that such elements are not to be interpreted under 35 U.S.C. 112(f).

What is claimed:

1. A drilling riser joint comprising at least one multiplexer line segment arranged in a longitudinal direction along and against an entire length of a main line of the drilling riser joint, each end of the multiplexer line segment extending through a respective flange of the drilling riser joint and arranged for coupling to an opposing end of a multiplexer line segment of a second adjacent drilling riser joint, the opposing end extending through a respective flange of the second adjacent drilling riser joint.

2. A drilling riser joint according to claim 1 further comprising the ends being arranged for box-and-pin coupling.

3. A drilling riser joint according to claim 1 further comprising the ends being arranged for inductive coupling.

4. A drilling riser joint according to claim 1 further comprising the multiplexer line segment of the second adjacent drilling riser joint lying along and against an entire length of a main line of the second adjacent drilling riser joint.

5. A drilling riser joint according to claim 1 further comprising a clamp arranged to secure a portion of the multiplexer line segment to the main line of the drilling riser joint.

6. A method of running a multiplexer line along a drilling riser, the method comprising the steps of:

coupling a first multiplexer line segment extending between flanges of a first drilling riser joint to a second multiplexer line segment extending between flanges of a second adjacent drilling riser joint, each of the first and second multiplexer line segments lying along and against a main line of the first and second drilling riser joints, respectively, and including an end that extends through a flange of the respective drilling riser joint;

wherein when coupled together the first and second multiplexer line segments form a portion of the multiplexer line along the drilling riser.

7. A method according to claim 6 wherein the coupling is a box-and-pin coupling.

8. A method according to claim 6 wherein the coupling is an inductive coupling.

* * * * *